United States Patent [19]

Kupersmit

[11] Patent Number: 4,946,036

[45] **Date of Patent: * Aug. 7, 1990**

[54] CRADLE CONSTRUCTION FOR SHIPPING CONTAINERS

[76] Inventor: Julius B. Kupersmit, 299 W. 12th St., New York, N.Y. 10014

[ * ] Notice: The portion of the term of this patent subsequent to Apr. 18, 2006 has been disclaimed.

[21] Appl. No.: 358,249

[22] Filed: May 30, 1989

[51] Int. Cl.[5] ..... B65D 19/00

[52] U.S. Cl. ..... 206/386; 206/298; 206/583

[58] Field of Search ..... 224/250–253; 206/386, 600, 583, 298; 229/23 R, 23 BT

[56] References Cited

U.S. PATENT DOCUMENTS

| | | | |
|---|---|---|---|
| 2,535,233 | 12/1950 | Ross | 229/23 R |
| 3,388,792 | 6/1968 | Jones | 206/583 X |
| 3,493,101 | 2/1970 | Collin | 229/23 BT |
| 3,682,358 | 8/1972 | Ridley | 224/250 X |
| 4,576,280 | 3/1986 | Dove et al. | 206/298 X |
| 4,685,571 | 8/1987 | Hoss | 206/583 |
| 4,735,320 | 4/1988 | Hoss | 206/583 |
| 4,821,879 | 4/1989 | Kupersmit | 206/386 |

FOREIGN PATENT DOCUMENTS

| | | | |
|---|---|---|---|
| 2597071 | 10/1987 | France | 206/386 |

*Primary Examiner*—Bryon P. Gehman
*Attorney, Agent, or Firm*—Charles E. Temko

[57] ABSTRACT

An improved cradle construction for cradle-type collapsible shipping containers in which transported articles are stacked in vertical rows supported from a rigid bar extending between oppositely disposed sides of the container. The construction substantially eliminates movement of the contents of the container during shipping, and affords improved convenience in loading and unloading by the provision of improved strap elements forming the cradle. Also disclosed is an improved method for preparing elongated composite articles such as automotive wiring harnesses for shipment prior to engagement with supporting cradles.

3 Claims, 4 Drawing Sheets

CRADLE CONSTRUCTION FOR SHIPPING CONTAINERS

BACKGROUND OF THE INVENTION

This invention relates generally to the field of collapsible, reusable shipping containers, and more particularly to an improved form thereof, suitable for transporting manufactured subcomponents to a point of assembly where the container serves as a storage bin adjacent an assembly line. While the invention has application in a wide variety of assembly procedures, it has particular utility in the assembly of automotive vehicles and the like.

In the assembly of relatively large components to form a completed product, components are normally individually wrapped or packaged, following which they are placed in a larger container for shipment to a point of assembly. Upon arrival, they are individually removed from the larger container, unwrapped and positioned at a point along the assembly line for subsequent integration. To facilitate such positioning, the components are sometimes positioned in trays which are stacked within the larger container, and the trays are removed from the container in serial fashion.

The problems accompanying such procedure are readily apparent. In some cases, the components must be individually unwrapped leaving wrappers to be discarded. In the case of the above-mentioned stacked trays, the trays must be stored after removal of the components therefrom to occupy valuable space adjacent the assembly line. If the trays are reusable, they also occupy sufficient space within the larger container to prevent the container from being collapsed for return shipment. Where the components are relatively heavy, it is difficult to remove the supporting trays from the container since they must be lifted from the side edges thereof, thus requiring access to the container on all sides thereof for manual engagement.

In the above-identified copending application, there is disclosed an improved shipping container of the class described in which the above-mentioned difficulties have been substantially eliminated. The shipping container comprises a collapsible, reusable, generally rectangular box element which is preferably supported upon an interconnected rigid pallet of known type. One of the vertical side walls of the container defines an opening therein providing access to the interior thereof after removal of an upper lid element and a front door. The upper horizontal edges of a pair of oppositely disposed side walls on either side of the opening are reenforced, and are provided with channel-forming members which support a plurality of elongated supporting bars therebetween for movement laterally toward and away from the opening. The bars, in turn, support along the length thereof, plural strap-like cradles, each including plural segments which jointly support elongated components in vertically stacked relation. The segments are individually opened to allow release of individual parts for removal as required starting from the lowermost part in a given stack. When all of the parts in a single stack have been removed, the corresponding bar is also removed, and the immediately adjacent bar is moved in a direction toward the access opening where the process is repeated until the parts carried by the successive stacks have been removed. With the removal of the last stack, the bars and cradles may be stored upon the bottom wall of the container, following which the container is then collapsed along fold lines above and parallel to the bottom wall to allow return shipment of the container to a point of origin while occupying substantially reduced volume.

The above-described structure, while making a significant contribution to the art, does not provide for certain recently discovered problems. A first is the shifting of backed contents within the container, which, in extreme cases, can create a pendulum effect capable of cracking or rupturing the container. A second problem is the tendency of the described cradle to stretch with continued use, thereby weakening the supporting capability of the same. Further, the necessity of a large number of hooks carried by the supporting cross bar which are mounted in holes in the bar, tends to permit the bar to bend in the medially disposed portions thereof under stress. Finally, in the case of composite products such as automotive wiring harnesses which must be held together during shipment, the harnesses have not provided adequate constraint upon the product prior to and after removal from the supporting cradle.

SUMMARY OF THE INVENTION

Briefly stated, the invention contemplates the provision of an improved cradle-type shipping container of the class described, in which the above-mentioned shortcomings have been substantially eliminated. To this end, the disclosed embodiment includes an improved cradle structure in which each of the cradle loops is formed to include an orificed grommet at a free end of each of the strap members, the grommet selectively engaging a single-hook structure on the supporting bar or rod. The channel engaging members on the cross bar or rod are enlarged in an axial direction, so that when placed in abutted relation when the container is fully loaded, the members at each end of the abutted row may be locked against movement relative to the channel forming members by transversely extending pintles which extend into the path of relative travel. To maintain the integrity of individual product items, such as wiring harnesses, a method is disclosed for the engaging of the loose conductors at each end of a relatively rigid harness with elongated segments of tape of relatively limited adhesivity which are applied in areas which will not be engaged by the cradle when the harness is positioned within the container. In this method, a minimum number of taped segments need be employed, and when the taped segments are removed along the assembly line, they do not create substantial waste material requiring disposal.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
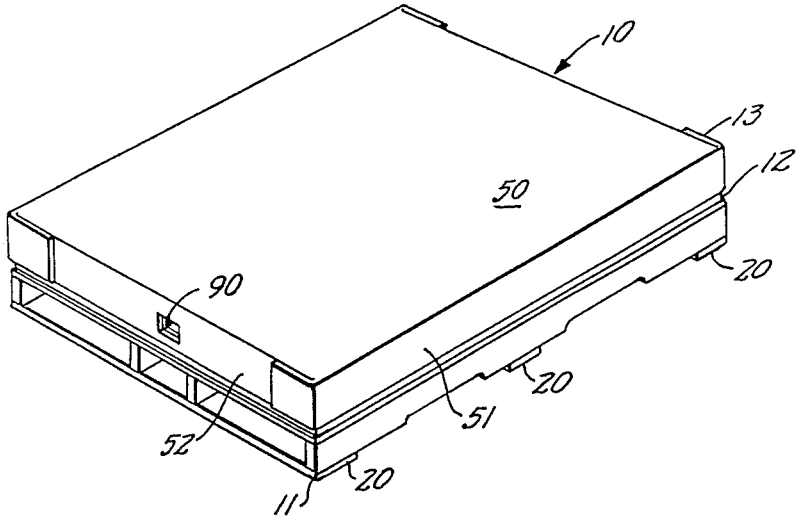
FIG. 1 is a view in perspective of the embodiment of the invention in fully collapsed condition with an upper lid in position.
Figure 3:
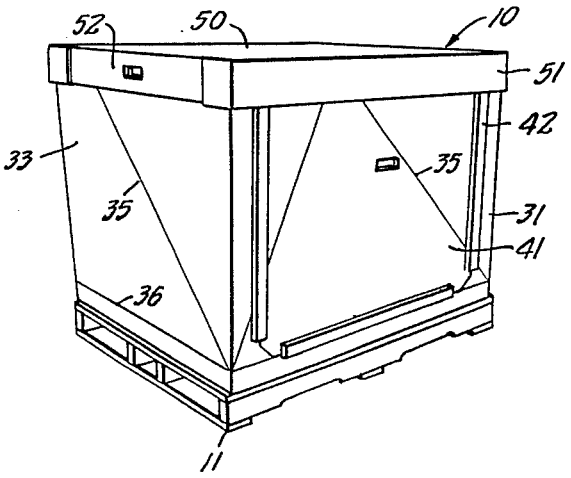
FIG. 3 is a view in perspective thereof showing the device in loaded condition ready for shipping.
Figure 2:
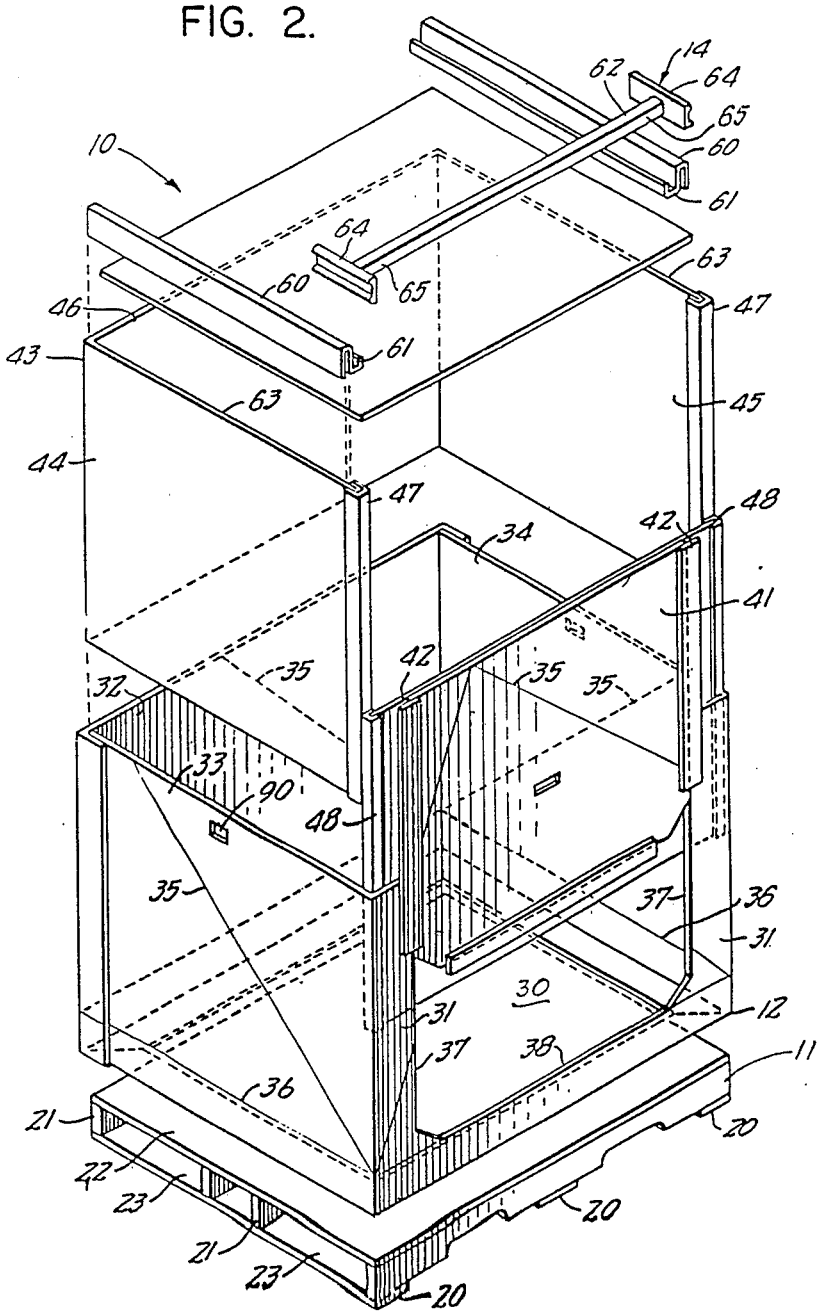
FIG. 2 is an exploded view in perspective thereof showing the same in fully erected condition prior to loading.
Figure 4:
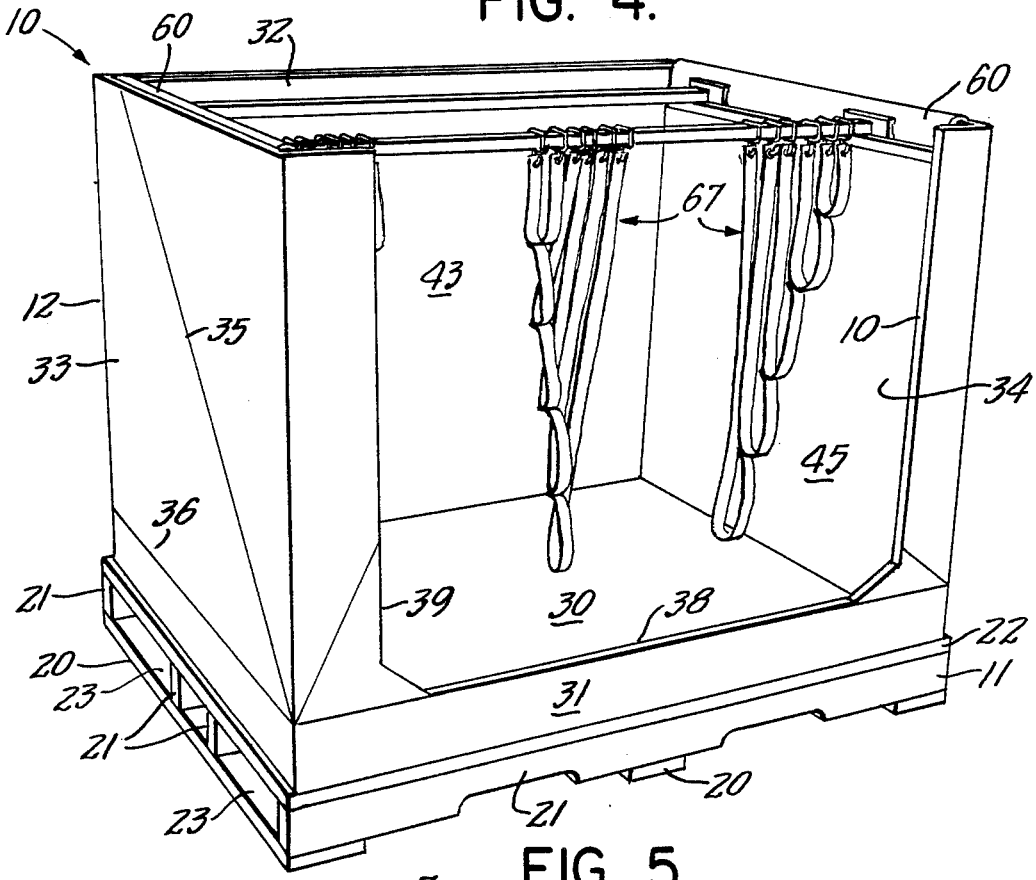
FIG. 4 is a view in perspective thereof showing the positioning of load supporting elements including web cradles prior to loading.

In accordance with the invention, the device, generally indicated by reference character 10, comprises broadly: a pallet element 11, a collapsible box element 12, a lid element 13, and a plurality of load-supporting elements 14.

The pallet element 11 is of known type, preferably formed from wood or other rigid materials, and includes a plurality of lower skid members 20, spaced vertical supporting members 21, and an upper wall 22, the members 21 forming openings 23 for engagement of a fork lift (not shown).

The box element 12 is preferably of heavy duty corrugated paper construction, and includes a lower wall 30, a front wall 31, a rear wall 32, and a pair of opposed side walls 33 and 34. The walls are provided with angularly disposed fold lines 35 to permit the container to be collapsed above a plane defined by horizontal fold lines 36, so as to provide space for storage of the elements 14 when not in use.

The front wall 31 is provided with a rectangular opening 37 bounded by a lower edge 38 and side edges 39 and 40. This opening is closed by a front door (not shown) which engages the edges 38–40 by means of extruded synthetic resinous channel members 42 having an "H" cross section. To provide sufficient rigidity, the walls 32–34 are reenforced by an insert member 43 including corresponding side walls 44 and 45, and rear wall 46. Reenforcement is provided behind the front wall 31 by synthetic resinous or metallic edge-supporting extrusions 47 on the free edges of the insert member, and extrusions 48 on the vertical free edges of the laminated door 41.

The lid element 13 is generally conventional, and can be formed from a single piece of corrugated material. It includes an upper wall 50, a pair of longitudinal side walls, one of which is indicated by reference character 51, and a pair of transverse side walls, one of which is indicated by reference character 52. The support elements 14 are supported upon a pair of channel forming members 60 which engage opposed upper edges of the insert member 43, and define a pair of parallel upwardly facing channels 61 which engage the free ends of transversely extending support bars or rods 62, so as to be disposed inwardly of the upward edges 63 of the side walls 33–34. The bars 62 are provided with corresponding channel engaging members 64 at the free end 65 thereof, the members 64 being preferably coated with nylon or other lubricant to facilitate movement within the channel 61.

Figure 6:
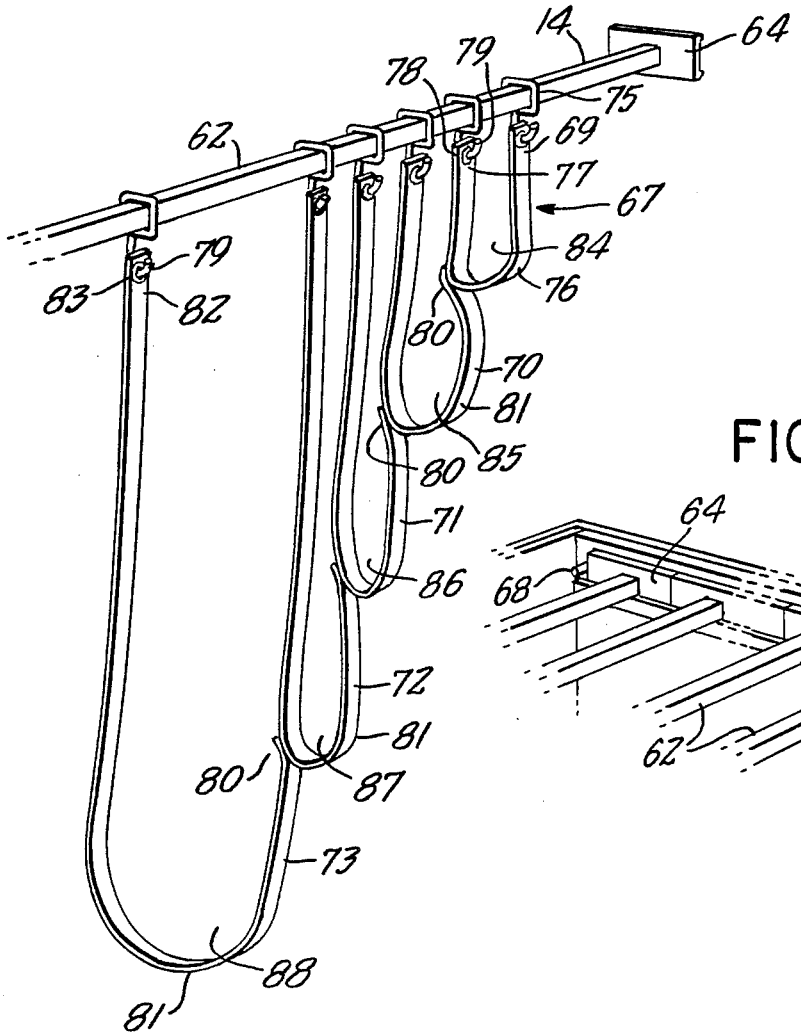
FIG. 6 is a view in perspective showing the details of an individual web cradle.
Figure 9:
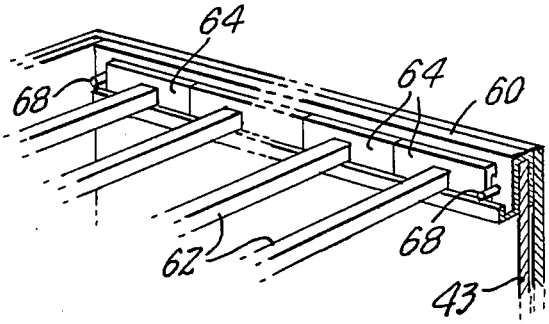
FIG. 9 is a fragmentary perspective view of the structure shown in FIG. 7.
Figure 7:
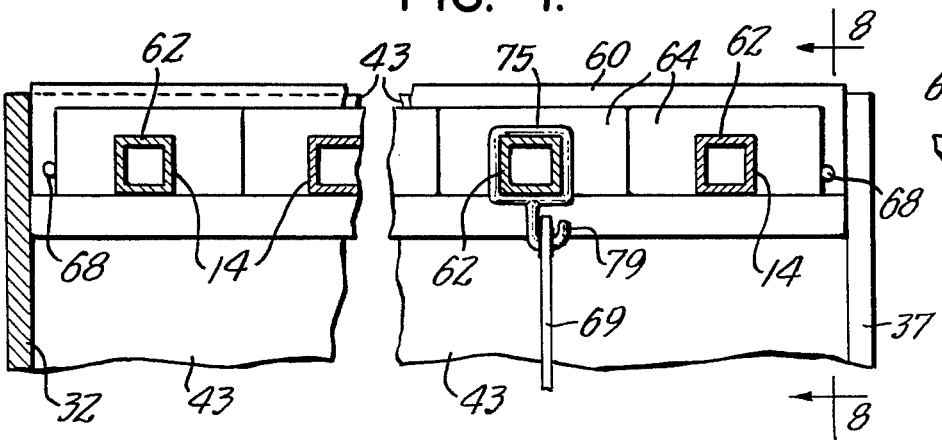
FIG. 7 is a vertical sectional view as seen from the plane 7—7 in FIG. 5.
Figure 8:
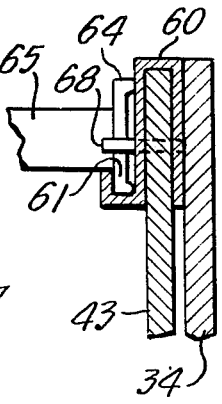
FIG. 8 is a sectional view taken on the line 8—8 as seen in FIG. 7.

Medially of the free end 65, the bars 62 are provided with multiple cradle elements 67 best seen in FIG. 6 in the drawings. Each cradle member includes a primary strap member 69 which indirectly or directly supports strap members 70, 71, 72 and 73, each of which, in engaged condition, defines an enclosure or loop engaging a component part or other object 74.

The primary strap member 69, which is preferably composed of woven webbing, includes a first end loop 75 which surrounds the bar, a medial portion 76, and a second end 77 having a grommet or eyelet 78 defining an opening which engages a hook 79. Each succeeding strap member 70–73 which depends from the member 69 includes a first end 80 which is permanently interconnected to a medial portion of a preceding strap, its own medial portion 81, and a second end 82 having a grommet 83 which engages a hook 79 as well. Thus, when fully interconnected, there are a series of loop openings, 84, 85, 86, 87 and 88, each of which surrounds a portion of a part 74.

At this point in the disclosure, a discussion of the loading and unloading of the embodiment is apposite. The embodiment may be erected from a collapsed condition in a manner well known in the art to the condition shown in FIG. 1 in the drawings, following which the insert member 43 is positioned within the opened confines of the box prior to the commencement of loading. The channels members 42 are then positioned, and a first bar or rod 62 is then positioned thereon adjacent the opening 37.

The loaded parts 74 will normally be of generally elongated configuration, as exemplified by an axle, or a wiring harness. Each such part will normally be supported adjacent the ends thereof, and at the middle. Loading commences by first commencing the strap members 69 at the upper end of a stack to be formed, and each succeeding part is then positioned therebeneath to be engaged by one of the strap members 70–73 in a similar manner.

In the case where the loaded part or object is a composite one, as for example, an automotive wiring harness including a relatively rigid sheath from which plural wires project at either end, it is desirable to anchor the exposed segments of the wires to the sheath to avoid entanglement with the wires of other similar wiring harnesses. In place of the usual bulky paper wrapping in sheet form, or the like, the invention contemplates the use of short lengths of synthetic resinous tape lightly coated with a pressure sensitive adhesive on one or both sides thereof which is employed to fasten the wires to the sheath prior to and after packing, the tape being removed for installation of the part at a point on a production line.

Figure 5:
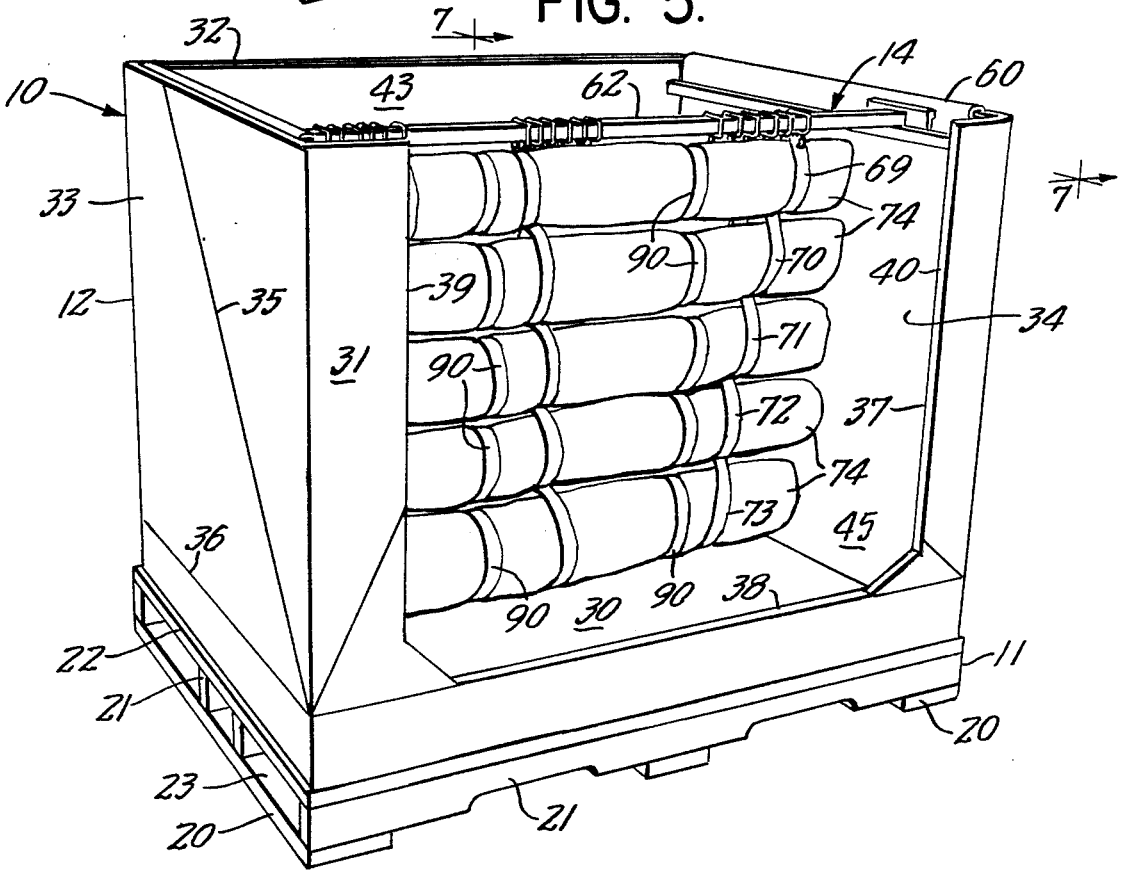
FIG. 5 is a view in perspective showing one fully loaded supporting element.

As illustrated in FIG. 5, the tapes 90 may be employed for this purpose are located in areas spaced from the areas of engagement by the cradle straps 61, so that when packed, the cradle straps perform not only a support function, but a function similar to that of the tape 90.

With the complete loading of a stack of parts 74, the entire stack, supported by the bar 62, is then moved rearwardly to lie adjacent the rear wall 32, a second bar 62 is positioned in similar fashion, and another stack is formed in a similar manner. This process is continued until a sufficient number of stacks has been formed to completely fill the interior of the box element 12.

Referring to Figure with the complete filling of the box element 12, the channel engaging members 64, which are considerably larger than those disclosed in the above-mentioned copending application are in abutted relation, and movement along the channel forming members 60 is prevented by the laterally directed insertion of pintles 68 which extend across the path of movement at each end of the abutted row of channel engaging members.

Upon arrival at the assembly plant, the device may be positioned adjacent an assembly station, the lid element removed and the front door 41 disengaged. At this point, unloading takes place commencing with the lowermost part supported by strap member 73 in the stack located immediately adjacent the opening 37. The strap members 70–73 are then disengaged in reverse serial fashion, whereby each such disengagement makes available another part for movement to the point of assembly. Strap member 69, being opened in a similar fashion, completely empties back, following which the corresponding rod 62 is lifted from engagement with the channel 61, and the next stack is then moved forwardly adjacent the opening 37 where the process is repeated. Upon retrieval of the last part in the final stack, the bars 62 may be positioned upon the lower wall 30, and the box element collapsed with the lid element 13 being repositioned as shown in FIG. 1 for reshipment to a point of origin.

Normally, no individual wrapping or packaging will be required in the case of component parts which are either sufficiently rigid or flexible to prevent damage. When the box element is fully loaded, the suspended parts will be capable of little, if any, relative motion, and thus will be fully protected against damage during shipment. Movement of the bars or rods 62, being locked against axial movement by the pintles 68 completes the total immobilization of the load during shipment.

I wish it to be understood that I do not consider the invention to be limited to the precise details of structure shown and described in the within specification, for obvious modifications will occur to those skilled in the art to which the invention pertains.

I claim:

1. In a shipping container including a generally rectangular box element having a bottom wall, a pair of oppositely disposed vertical side walls, a vertical rear wall and a vertical front wall defining an opening therein, said side walls having horizontal upper edges, channel-forming means supported by said horizontal edges, and plural load supporting elements, each including an elongated bar having first and second channel engaging members at opposite ends of said bar, each of said bars having plural load supporting cradles in pendent relation thereto, the improvement comprising: said load supporting cradles including an elongated primary strap having first and second ends, said first end being detachably secured to said bar, said bar having plural hooks thereon, said second end having a grommet thereon defining an opening, said opening being selectively engageable with one of said plural hooks.

2. The improvement in accordance with claim 1, further characterized by said load supporting cradles including dependent strap members, each having a first end secured to a medial segment of said brackets primary strap member, and a second end having a grommet defining an opening selectively engageable with one of said hooks.

3. In a shipping container, including a generally rectangular box element having a bottom wall, a pair of oppositely disposed vertical side walls, a vertical rear wall, and a vertical front wall defining an opening therein, said side walls having horizontal upper edges, channel-forming members supported by said horizontal upper edges, and plural load supporting elements, each including an elongated bar having first and second channel-engaging members at opposite ends of said bar, each of said bars having load supporting cradles in pendent relation thereon, the improvement comprising: said channel-engaging members having an axial length such that when all of said bars are in engaged condition upon said channel-forming members, said channel-engaging members are placed in abutted relation; and first and second pintle means selectively penetrating said channel-forming members and abutting the exposed end surfaces of the first and last of said channel-engaging members to prevent relative movement between said channel-engaging members and said channel-forming members.

* * * * *